US005676319A

United States Patent [19]

Stiggins et al.

[11] Patent Number: 5,676,319

[45] Date of Patent: Oct. 14, 1997

[54] GARBAGE DISPOSAL SYSTEM

[76] Inventors: Kendy Lee Stiggins, 2801 Maple Ave., Waco, Tex. 76707; David A. Fanning, 4020 NE. 171st Ave., Vancouver, Wash. 98682; Stephen F. Gass, 22409 Newland Rd., Wilsonville, Oreg. 97070

[21] Appl. No.: 543,844

[22] Filed: Oct. 23, 1995

[51] Int. Cl.[6] ..... B02C 23/36

[52] U.S. Cl. ..... 241/46.012; 241/46.013; 241/46.016

[58] Field of Search ..... 134/115 G; 241/46.012, 241/46.013, 46.014, 46.015, 46.016, 46.017, 46.02

[56] References Cited

U.S. PATENT DOCUMENTS

| | | | |
|---|---|---|---|
| 2,785,863 | 3/1957 | Jordan . | |
| 2,842,320 | 7/1958 | Ewing | 241/46.012 X |
| 2,843,328 | 7/1958 | Stoynich | 241/46.012 X |
| 2,876,953 | 3/1959 | Shepherd . | |
| 2,880,941 | 4/1959 | Fox et al. . | |
| 2,918,222 | 12/1959 | Shepherd . | |
| 3,034,734 | 5/1962 | Guth . | |
| 3,344,996 | 10/1967 | Meyers . | |
| 3,510,069 | 5/1970 | Hannum . | |
| 4,183,470 | 1/1980 | Hovartos et al. . | |
| 4,776,523 | 10/1988 | Hurst . | |
| 5,308,000 | 5/1994 | Riley . | |

OTHER PUBLICATIONS

Brochure advertising different models of the In–Sink–Erator food waste disposers.

*Primary Examiner*—Mark Rosenbaum

*Attorney, Agent, or Firm*—Kolisch Hartwell Dickinson McCormack & Heuser

[57] ABSTRACT

The invention is a garbage disposal that includes a dishwasher drain connection to allow water and waste to enter the disposal from a dishwasher, a water input port also to allow water to enter the disposal, a valve associated with the water input port to block the flow of water through the water input port until the valve is actuated, and a switch assembly to actuate both the disposal and the valve. In one embodiment of the invention a coupler is connected to the dishwasher drain connection, where the coupler accepts both a dishwasher drain hose and a water supply hose, so that the dishwasher drain connection acts as the water input port. Another embodiment of the invention includes a coupler adapted to be installed on and modify existing disposals according to the invention. The invention also includes a method of modifying garbage disposals according to the invention.

5 Claims, 3 Drawing Sheets

GARBAGE DISPOSAL SYSTEM

TECHNICAL FIELD

This invention relates to garbage disposal systems for use in homes. More particularly, it relates to a garbage disposal in a kitchen sink used to comminute biodegradable waste, where water is automatically fed into the disposal when the disposal is actuated.

BACKGROUND OF THE INVENTION

A garbage disposal is a comminuting device used to grind refuse into small particles. In a home, a garbage disposal is attached to the drain of a kitchen sink so that food and biodegradable waste may be ground into small particles and then washed away with waste water.

Garbage disposals are actuated by a switch located remote from the garbage disposal, for example, on a wall near the sink. Prior to actuating the disposal, a user turns on the sink's water and directs it into the garbage disposal so that the water will carry any waste in the disposal through the disposal. The water also acts to cool the garbage disposal. Thus, in operation, a user turns on the water, directs it into the garbage disposal, turns on the disposal, waits while the disposal grinds refuse, turns off the disposal, and then turns off the water, in that order. While the disposal is operating the water should not be directed away from the disposal, otherwise the disposal may clog or overheat. That process is cumbersome and limits the use of the sink and its water when the disposal is on. It also requires the user to remember to turn on the water before the disposal, and to turn it off after the disposal. This invention addresses those problems.

Garbage disposals are also used in conjunction with dishwashers. A conduit is connected between a dishwasher and the garbage disposal so that water and waste from the dishwasher travels into the disposal. By so doing, pieces of refuse from the dishwasher collect in the disposal rather than traveling directly into the house's waste system, and will be comminuted when the disposal is next actuated.

This invention provides a disposal for use with a dishwasher as described. It also provides a modification to existing disposals, solving the drawbacks of past disposals while maintaining the ability to use the disposal with dishwashers.

BRIEF SUMMARY OF THE INVENTION

The invention is a garbage disposal that includes a dishwasher drain connection to allow water and waste to enter the disposal from a dishwasher, a water input port also to allow water to enter the disposal, a valve associated with the water input port to block the flow of water through the water input port until the valve is actuated, and a switch assembly to actuate both the disposal and the valve. In one embodiment of the invention a coupler is connected to the dishwasher drain connection, where the coupler accepts both a dishwasher drain hose and a water supply hose, so that the dishwasher drain connection acts as the water input port. Another embodiment of the invention includes a coupler adapted to be installed on and modify existing disposals according to the invention. The invention also includes a method of modifying garbage disposals according to the invention.

DETAILED DESCRIPTION OF THE PREFERRED EMBODIMENT AND BEST MODE OF CARRYING OUT THE INVENTION

Figure 1:
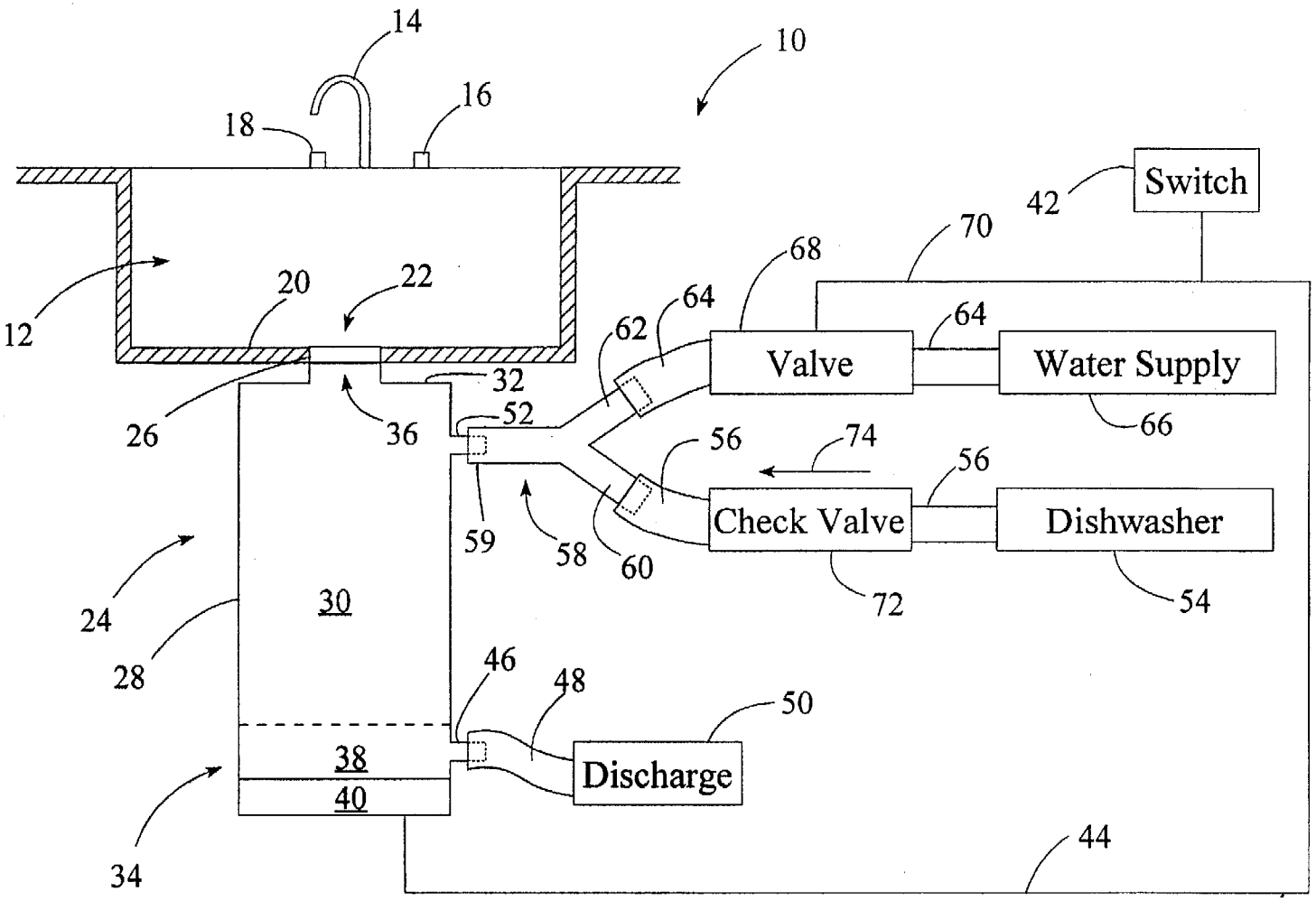
FIG. 1 is a schematic drawing of the invention.

The invented garbage disposal system is shown at 10 in FIG. 1. The system includes a sink 12, having a water spigot 14 and hot and cold water valves 16 and 18, respectively, to control the flow of water from the spigot. The sink also includes a bottom 20, and a drain 22 in the bottom of the sink. The sink is typically installed in the kitchen of a home so that the top of the sink is adjacent and substantially in line with a counter. The sink may take many different forms.

A garbage disposal 24 is connected to the bottom of the sink at drain 22 by a connector 26. Garbage disposal 24 may be of virtually any type. It includes an enclosure 28 defining a cavity 30. The cavity is oriented relative to the sink so that it has a top 32 and a bottom region 34. The disposal also includes a main opening 36 in the top of the enclosure. A comminuting or grinding mechanism 38 is positioned within and toward the bottom of the cavity for comminuting or grinding refuse. The comminuting mechanism is powered by a motor 40. The motor is typically an electric motor plugged into an electric outlet adjacent the sink. The motor and comminuting mechanism are actuated by a switch assembly 42 connected to the motor by wire 4.4.

Garbage disposal 24 also includes an exit 46 within and toward the bottom of enclosure 30 for allowing water and comminuted waste to leave the cavity. The water and waste then travel though a pipe or other conduit 48 into a discharge system 50, such as a sewer or septic tank.

When water is directed into the sink from spigot 14, it will flow through drain 22 and main opening 36 into cavity 30 of garbage disposal 24 due to gravity. Any food particles or other waste in the sink will be washed into the disposal along with the water from the spigot. Comminuting mechanism 38 will then grind the waste into small particles, and the particles and waste will exit the disposal through exit 46 and enter into the home's discharge system.

Disposal 24 also includes a dishwasher drain connection 52 associated with the enclosure and positioned above the comminuting mechanism but below of the top of the enclosure. Dishwasher drain connection 52 allows water and waste from a dishwasher 54 to enter cavity 30. The dishwasher drain connection is connected to the dishwasher by a dishwasher drain hose or conduit 56. Thus, waste from the dishwasher may be comminuted prior to entering the home's discharge system.

Attached to the dishwasher drain connection is a coupler 58. The coupler includes a connector region 59 configured to fit over the dishwasher drain connection, as shown in FIG. 1. A clamp or friction may hold the coupler in place. Alternatively, the coupler may be joined to the dishwasher drain connection by a hose, in any known manner.

The coupler further includes a first region 60 configured to accept dishwasher drain hose 56. The coupler is constructed with an interior passage so that water and waste may travel from dishwasher 54, through hose 56 and coupler 58 into garbage disposal 24. Hose 56 may be connected to first region 60 in any known way, such as by a friction fit, pressure fit and/or a clamp.

Coupler 58 also includes a second region 62 configured to accept a water supply hose 64. The coupler is constructed to include an interior passageway so that water may flow from hose 64 through the coupler and into the garbage disposal. Hose 64 is connected to a water supply 66, which typically is the same supply as that which provides water to spigot 14. One way to make that connection is to insert a T-joint into the cold water supply of the sink, preferably just after the water shut-off valve for the sink. The T-joint would simply be interposed between the water shut-off valve and the robing attached to the cold water valve 16.

A water valve 68 is also positioned in the path of water supply hose 64. Valve 68 is typically an electrically powered solenoid valve. When actuated, it opens and allows water to flow from the water supply, through hose 64 and into the disposal. At other times, the valve blocks the flow of water through the hose. The valve is controlled by switch 42, and connected to that switch by wire 70. The valve is sometimes plugged into the same electric outlet which powers the motor of the disposal. Alternatively, the valve may be wired directly into the home's electrical system or motor 40.

A check valve 72 is located in the path of dishwasher drain hose 56. The check valve permits water and waste to travel through the hose only in the direction of arrow 74. Thus, water traveling through coupler 58 from water supply 66 cannot travel back to dishwasher 54. Additionally, water and waste within cavity 30 of the disposal cannot travel back to the dishwasher. If, however, dishwasher 54 includes a check valve adjacent its connection to hose 56, then a check valve adjacent the disposal or within the hose could be unnecessary. The check valve may be of any type, including gravity and spring biased valves. Valve 68 also blocks water from flowing out of the disposal and through hose 64 toward the water supply 66.

The above described system permits a user to operate the disposal without having to turn the water on at the sink's spigot, and allows the user to use the spigot without having to direct water into the disposal. When the user turns on switch 42, valve 68 opens and water immediately flows into the disposal. Check valve 72 prevents water from entering the dishwasher. Simultaneously, motor 40 is actuated and the disposal begins comminuting any waste within cavity 30. The water and comminuted waste then leave the disposal through exit 46 and enter the home's discharge system.

Figure 2:
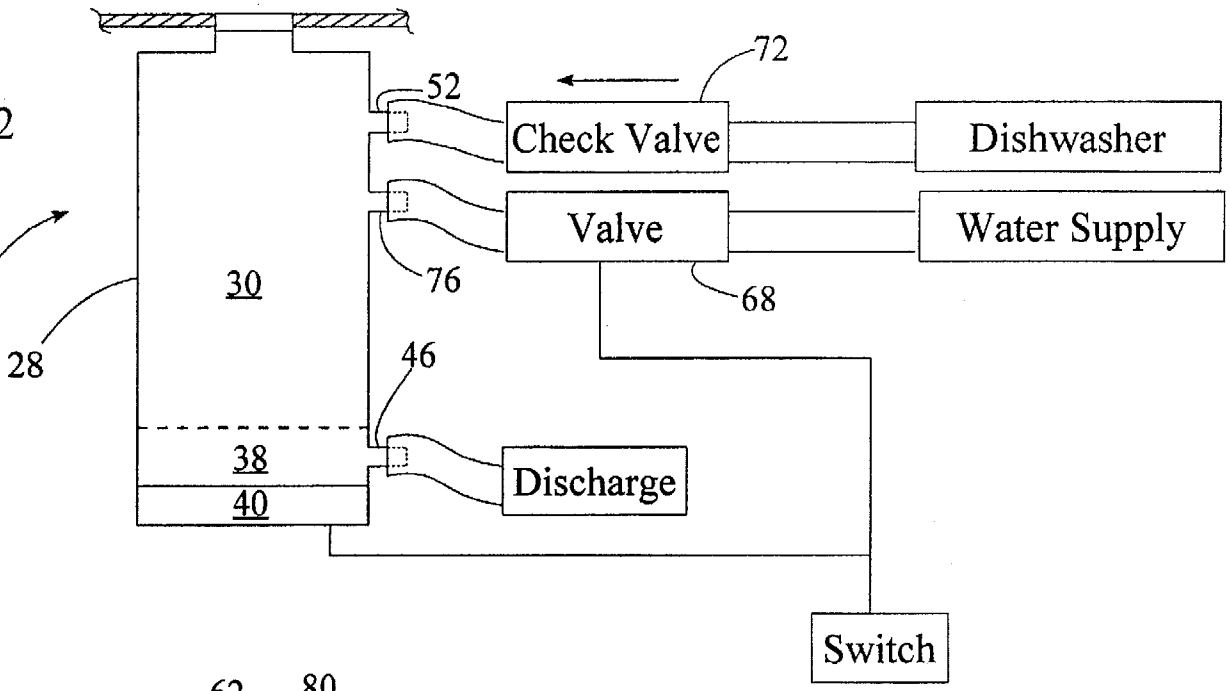
FIG. 2 is a schematic drawing of a second embodiment of the invention.

A second embodiment of the invention is shown in FIG. 2. That embodiment includes many of the elements described above, but further includes a water input port 76 in enclosure 28. That port replaces the coupler described above because it allows water to enter the garbage disposal from the water supply above the comminuting mechanism and below the top of the disposal. The flow of water through water input pert 76 is controlled by valve 68, as described above.

Alternatively, valve 68 may be directly incorporated into the disposal to facilitate installation of the disposal in a home. Likewise, check valve 72 may be constructed within or adjacent dishwasher drain connection 52. Either or both of those constructions provide for a compact, easy-to-install disposal that has the advantages described above.

As shown in FIG. 1, coupler 58 is constructed in the shape of a "Y". That shape directs water traveling from either the water supply or the dishwasher through the dishwasher drain connection 52 and into the disposal. It also directs water flowing through either the first or second region of the coupler away from the other region. Thus, the "Y" shape lessens the amount of water that will travel from water supply 66 back into hose 56, or vice versa.

Figure 3:
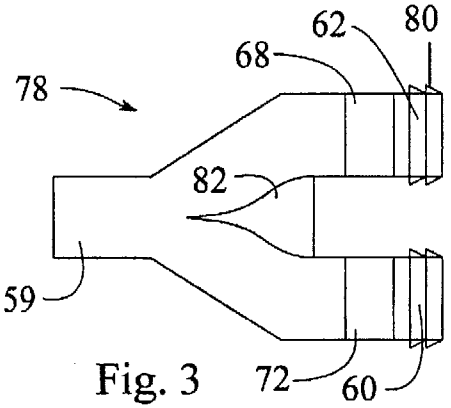
FIG. 3 is a drawing of a coupler for use in the invention.

A modified Y-shaped coupler is shown at 78 in FIG. 3. That coupler includes water valve 68, represented as a block shape, included with and built in the coupler. Similarly, check valve 72, also represented as a block shape, is included with and built in the coupler. Again, that construction facilitates installation of the coupler and provides a compact unit. First and second regions 60 and 62, respectively, include ridges or teeth to grip the overlying ends of hoses 56 and 154. Connector region 59 may or may not include ridges, depending on how it will be attached to the dishwasher drain connection.

The coupler shown in FIG. 3 also includes a divider 82 positioned within the coupler to define two substantially separate passageways through the coupler, one from first region 60 to connector region 59, and the other from second region 62 to end 59. That divider helps limit water from flowing from the first or second regions to the other.

Figure 4:
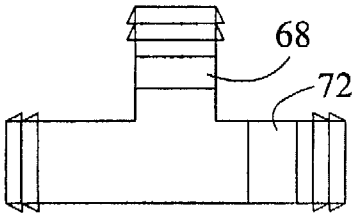
FIG. 4 is a drawing of another coupler for use in the invention.
Figure 5:
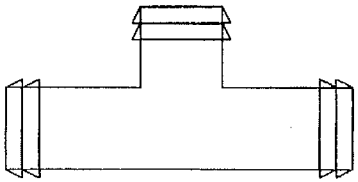
FIG. 5 is a drawing of yet another coupler for use in the invention.

Other shapes of couplers may also be used. For example, FIG. 4 shows a T-shaped coupler with a water valve 68 and a check valve 72 built into the coupler. FIG. 5 shows a T-shaped coupler without a water or check valve. Although a coupler of unitary construction is preferred, it should be understood that discrete components could be assembled to achieve the same connections.

Figure 6:
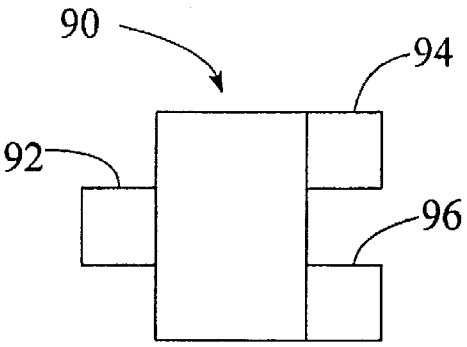
FIG. 6 is a drawing of a three way valve for use in the invention.

In yet another embodiment of the present invention, a three way valve 90, shown in FIG. 6, is used to selectively connect either the water supply or the dishwasher drain hose into the dishwasher input port. This embodiment has the advantage of simplicity of construction, and does not require a check valve to prevent flow back into the dishwasher. On the other hand, when the valve is activated to allow water to flow into the disposal, the dishwasher drain is temporarily blocked. That valve includes common port 92 for connection to the dishwasher drain connection, a normally closed water supply port 94 connected to the water supply and a normally open dishwasher drain port 96 connected to the dishwasher drain hose. Prior to activation of the valve, the valve blocks water flow from the water supply and allows the dishwasher hose to flow into the cavity. Once the valve is activated, it connects the water supply port to the common port and closes the dishwasher drain port to prevent flow back into the dishwasher.

As an alternative to incorporating a check valve into the system, it is possible to restrict the flow of water from the water supply, using a flow restrictor for example, to an amount that would not generate any significant back pressure at the connection to the dishwasher drain hose. The normal elevation of the dishwasher drain hose is above the level of the dishwasher drain connection 52, which prevents passive back flow of water into the dishwasher.

Figure 7:
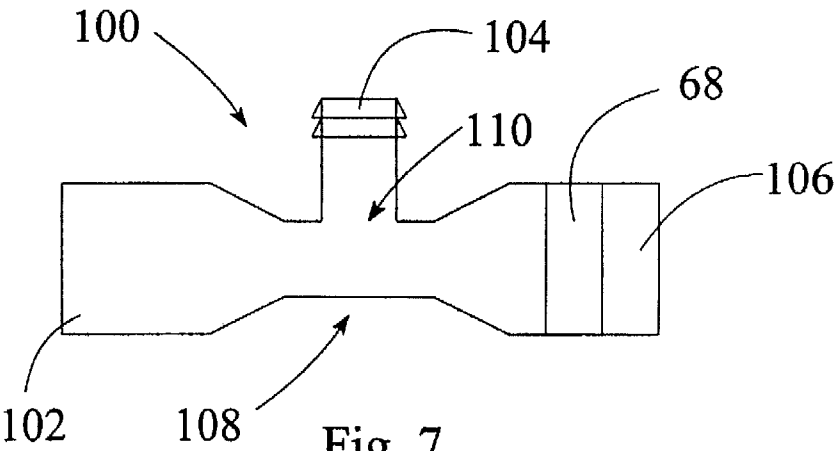
FIG. 7 is a drawing of a coupler employing a venturi effect.

Another coupler is shown in FIG. 7. That coupler eliminates the need for a check valve by using a venturi effect to prevent water from flowing back into the dishwasher drain hose. That coupler is shown at 100, and includes a connector region 102 adapted to connect to the dishwasher drain connection, a first region 104 adapted to connect to the dishwasher drain hose, a second region 106 configured to accept the water supply hose, and a water valve 68 adjacent the second region to selectively block the flow of water from the water supply. The coupler also includes a venturi section 108 with a smaller cross-section than connector region 102. That differential in cross-section creates the venturi effect, and causes the pressure at region 110 to be less than at connector region 102. Because connector region 102 is vented to atmosphere through the disposal, the pressure at region 110 will be less than atmospheric pressure. First region 104 is vented to atmosphere through the dishwasher, so it is also at a higher pressure than region 110. That pressure differential will substantially prevent water from flowing back into the dishwasher from second region 106.

One aspect of the invention is that it may be sold as a retrofit kit to modify existing disposals. The kit would include a coupler, as described above, a water conduit to connect the coupler to the water supply, and a solenoid valve, either separate from or integral with the coupler, to function as described above. The kit may also contain a check valve, again, either separate from or integral with the coupler, necessary conduits, and a T-joint to connect to the sink's water shut-off valve.

The invention further includes a method of modifying a garbage disposal so that water automatically enters the disposal when the disposal is actuated. The method includes the step of providing an input to allow water to enter a grinding cavity of a disposal. That input may be part of the disposal, or may be drilled, or tapped into the disposal. The method further includes the steps of connecting a water conduit to the input and to a water supply, as described, placing a water valve in the path of the water conduit to block the flow of water from the water supply until the water valve is actuated, at which time it allows water to pass through the water conduit into the disposal through the input, and connecting the water valve to the switch assembly so that when the switch assembly actuates the disposal it also actuates the water valve.

INDUSTRIAL APPLICABILITY

The invented garbage disposal system is applicable for home garbage disposals. It is particularly applicable where water is desired to flow through a garbage disposal automatically.

While specific embodiments and the best mode for carrying out the invention have been disclosed, modifications and changes may be made thereto without departing from the spirit and scope of the invention.

We claim:

1. A garbage disposal system comprising:

an enclosure defining a cavity and having a top and a bottom;

a main opening in the top of the enclosure allowing refuse to enter the cavity;

a comminuting mechanism within and toward the bottom of the cavity for comminuting refuse;

a motor associated with the comminuting mechanism for powering the comminuting mechanism;

an exit within the enclosure for allowing comminuted refuse to leave the cavity;

a dishwasher drain connection associated with the enclosure above the comminuting mechanism and below the top of the enclosure to allow water to enter the cavity through the dishwasher drain connection, where the dishwasher drain connection includes a projection extending outwardly from the enclosure;

a coupler operatively connected to the dishwasher drain connection's projection, where the coupler includes a first region configured to accept a dishwasher drain conduit through which water may travel from a dishwasher through the dishwasher drain conduit, the coupler, and the dishwasher drain connection into the cavity above the comminuting mechanism, and a second region configured to accept a water supply conduit through which water may travel from a water source through the water supply conduit, the coupler and the dishwasher drain connection into the cavity above the comminuting mechanism, where the coupler is a unitary structure, and where the first region includes a structure to which the dishwasher drain conduit is attached, and the second region includes a structure to which the water supply conduit is attached; and a water valve interposed between the water source and the dishwasher drain connection to block the flow of water until the water valve is actuated.

2. The garbage disposal of claim 1, further comprising a switch to actuate the motor and the water valve.

3. The garbage disposal of claim 1, further comprising a unidirectional flow control structure associated with the coupler to restrict fluid flow in the coupler to a single direction.

4. The garbage disposal of claim 1, further comprising a connector attached to the top of the enclosure to connect the enclosure to the bottom of a sink, and where the dishwasher drain connection is positioned so that it is below the bottom of the sink when the garbage disposal is connected to the bottom of the sink.

5. The garbage disposal of claim 1, where the water valve is a solenoid valve.

* * * * *